US011155758B2

(12) United States Patent
Shurtleff et al.

(10) Patent No.: US 11,155,758 B2
(45) Date of Patent: Oct. 26, 2021

(54) METHOD OF DOSING A SYSTEM WITH HCL THEN EVACUATING AND PURGING

(71) Applicant: Airgas, Inc., Radnor, PA (US)

(72) Inventors: Andy Shurtleff, New Braunfels, TX (US); Mark Joseph Doore, Perrysburg, OH (US); Andrew Slaugh, Oakwood Village, OH (US)

(73) Assignee: Airgas, Inc., Radnor, PA (US)

( * ) Notice: Subject to any disclaimer, the term of this patent is extended or adjusted under 35 U.S.C. 154(b) by 0 days.

(21) Appl. No.: 16/886,337

(22) Filed: May 28, 2020

(65) Prior Publication Data

US 2020/0377804 A1 Dec. 3, 2020

Related U.S. Application Data

(60) Provisional application No. 62/854,444, filed on May 30, 2019.

(51) Int. Cl.
*C10G 45/60* (2006.01)
*C10G 45/72* (2006.01)

(52) U.S. Cl.
CPC ..... *C10G 45/60* (2013.01); *C10G 45/72* (2013.01)

(58) Field of Classification Search
CPC ..... B67D 5/08
USPC ..... 208/108; 222/1, 59, 61, 71, 318; 137/205, 208, 209; 422/501, 509, 110
See application file for complete search history.

(56) References Cited

U.S. PATENT DOCUMENTS 5,148,945 A * 9/1992 Geatz ..... G01F 11/28 222/1
5,359,787 A * 11/1994 Mostowy, Jr. ..... C23C 16/4401 34/343
5,958,356 A * 9/1999 Dong ..... B01J 20/103 423/488
6,032,483 A * 3/2000 Paganessi ..... C01B 7/01 62/620
6,076,359 A * 6/2000 Jurcik ..... F17C 7/04 62/50.2
6,224,252 B1 * 5/2001 Munroe ..... B01F 13/10 366/131
6,363,728 B1 * 4/2002 Udischas ..... F17C 9/02 62/48.1
9,416,919 B2 * 8/2016 DeMars ..... F17D 3/01

* cited by examiner

*Primary Examiner* — Nina Bhat
(74) *Attorney, Agent, or Firm* — Elwood L. Haynes; Allen E. White

(57) ABSTRACT

A method of dosing a system with HCL is provided. The method includes at least two parallel trains. The method utilizes a first operating mode, wherein at least one primary train is actively providing HCL to an end user, and at least one secondary train is either inactive or also providing HCL to the end user. The method utilizes a second operating mode, wherein the least one primary train is evacuating the contents of the train to a disposal system, and the at least one secondary train is providing HCL to the end user. And the system utilizes a third operating mode, wherein the at least one primary train is purging the train, and the at least one secondary train is providing HCL to the end user. The first operating mode, the second operating mode, and the third operating mode are controlled by an electronic monitoring and control system.

11 Claims, 10 Drawing Sheets

METHOD OF DOSING A SYSTEM WITH HCL THEN EVACUATING AND PURGING

CROSS REFERENCE TO RELATED APPLICATIONS

This application claims the benefit of priority under 35 U.S.C. § 119 (a) and (b) to U.S. Provisional Patent Application No. 62/854,444, filed May 30, 2019, the entire contents of which are incorporated herein by reference.

BACKGROUND

Moisture sensitive process systems, such as refinery isomerization units, utilize hydrogen chloride for acidification curing to remove moisture entrapping ferric (iron) oxide (FeO2 or rust) following system construction, repairs or modifications. The hydrogen chloride is typically fed into the system in repeated cycles with a high flow injection followed by a reaction period. The ability to introduce the needed level of hydrogen chloride into the system quickly at the onset of the cycle provides the ability to achieve full reaction with any residual ferric oxide during the reaction period.

The reaction of ferric oxide with hydrogen chloride results in the formation of ferric chloride (FeCL) and water (H2O or moisture). Measurement of moisture following the reaction provides a measure of remaining ferric oxide contamination and effectiveness of the acidification process. Full removal of ferric oxide is indicated by an unchanged baseline for moisture at low concentrations.

Hydrogen chloride gas for this process is typically provided in high pressure cylinders of up to 65 pounds capacity or small bulk containers at up to 500 pounds capacity or more. Hydrogen chloride gas has a low vapor pressure at 21° C. room temperature of 613 psig and the gas is frequently fed into systems which are operating at 200 psig or higher. Removal of gas from cylinders or small bulk tanks at high flow rates results in quickly cooling of the container and lowering of the gas head pressure. This pressure lowering results in the slowing down of or completely stopping gas flow to process. Consequently, the ability to maintain needed hydrogen chloride flow and pressure can require that the gas cylinders or tank be maintained at an elevated temperature throughout the process or reheated by the start of the next flow cycle.

Users have generally experienced longer acidification process cycles due to this natural cooling. Operators have dealt with the cooling and loss of pressure and flow through a variety of means including switching from cooled to warmer cylinders throughout the process and/or application of direct or indirect heat to the gas container. Excessive heat applied to pressure vessels can and has resulted in catastrophic failure of the vessels or gas handling and control components.

Hydrogen chloride is also a hazardous gas which forms hydrochloric acid when combined with moisture. Human exposure can result in severe injury or death. The effects of excessive heating and cooling cycles as well as hydrogen chloride combined with moisture can create failure of supply system components and leaks resulting in gas release. Gas release can also result during the process of exchange and replacement of gas cylinders or tanks.

Summarizing the problems in the state-of-the art processes:

- They are labor intense manual operations which frequently require multiple intervening actions by operators
- Temperature extremes and cycles can result in gas release through leaks and cylinder exchange activities and even catastrophic failure of cylinders or supply system components
- Combining hydrogen chloride with moisture creates potential for corrosion of components which can result in failure to operate properly, leaks or catastrophic failure
- Loss of head pressure results in extended process cycles and resultant added labor, material and project costs The foregoing represents the state of the art and the augmentation of cylinder temperature using conventional methods have had only marginal benefit. In view of the foregoing, there is a clear, long felt need in the art for solutions to address the slow, problematic and potentially hazardous state of the art.

SUMMARY

A method of dosing a system with HCL is provided. In one embodiment the method includes a single train. In another embodiment, the method includes at least two parallel trains. The method utilizes a first operating mode, wherein at least one primary train is actively providing HCL to an end user, and at least one secondary train is either inactive or also providing HCL to the end user. The method utilizes a second operating mode, wherein the least one primary train is evacuating the contents of the train to a disposal system, and the at least one secondary train is providing HCL to the end user. And the system utilizes a third operating mode, wherein the at least one primary train is purging the train, and the at least one secondary train is providing HCL to the end user. The first operating mode, the second operating mode, and the third operating mode are controlled by an electronic monitoring and control system.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

ELEMENT NUMBERS

Figure 1:
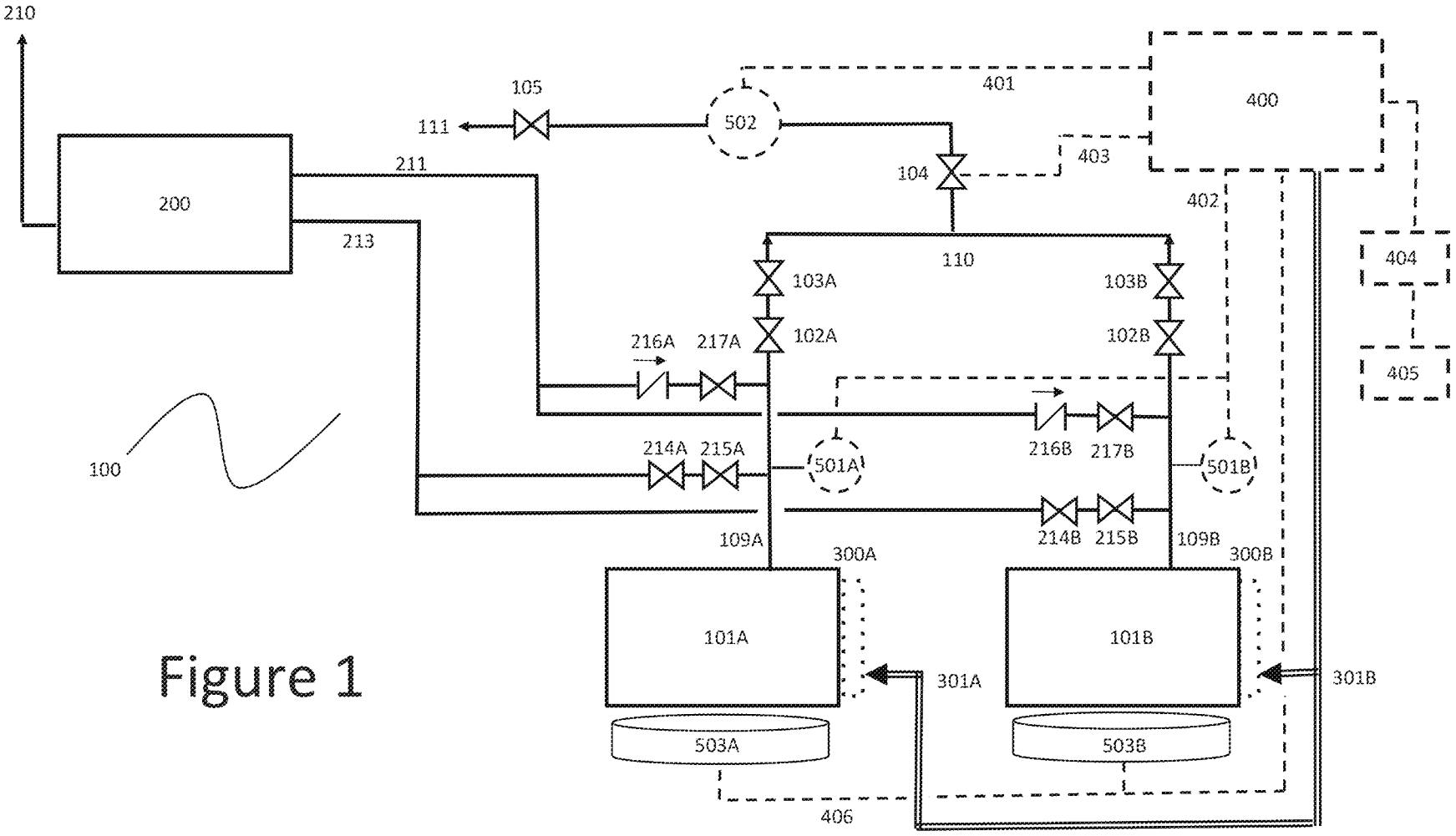
FIG. 1 is a schematic representation of the overall system, in accordance with one embodiment of the present invention.

100=System upplying and managing HCL for use in acidizing metal surfaces
101A/B=One or more HCL cylinder or bulk container
102A/B=Process Supply Gas Valve, First Isolation
103A/B=Process Supply Gas Valve, Second Isolation
104=Dosing Valve, Automated Control (On/Off)
105=Adjustable Flow Rate Control Valve
106=D.O.T. Container (Cylinder) of HCL (sizes vary)
107A/B=Manifold assembly connection multiple cylinders into a single common outlet
109A/B=Source supply scheme common outlet to system
110=Shared HCL manifold
111=Gas outlet to system to be acidified
200=Purge subsystem
202=Inert gas source for purge and motive to vacuum generator
203=Purge gas pressure reducing valve
205=Vacuum path (from system)
207=Vacuum generator motive gas valve (on/off)
208=Backflow prevention valve
209=Vacuum generator
210=System discharge to disposal system
211=Purge gas line to system
213=Vacuum line to system
214A/B=First vacuum line evacuation valve
215A/B=Second vacuum line evacuation valve
216A/B=Backflow prevention valve
217A/B=Purge gas inlet valve to process system
300A/B=Heating device applied to HCl supply cylinders
301A/B=Temperature sensing and power supply to heating device
400=Electronic Monitoring and Controls
401=Signal line from flow rate monitoring device (502)
402=Signal line from supply source pressure sensing devices (501)
403=Control line to HCL dosing control valve (104)
404=External signal input for gas leak detection
405=Alarms light and audible alarm signal device
406=Signal line from HCL source weighing devices (503)
501A/B=Pressure sensor for HCL source supply
502=Flow rate and total flow measuring device
503A/B=Sensor for HCL source weighing device

DESCRIPTION OF PREFERRED EMBODIMENTS

Illustrative embodiments of the invention are described below. While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of this disclosure.

The system described is designed for the dosing of hydrogen chloride gas (HCL) which will react through synthesis with iron oxide within a piping system. The reaction of the HCL and iron oxide results in water and other volatile compounds that are then removed from the system piping system. In order to determine the effectiveness of this iron oxide removal, the amount of water generated from the reaction is measured and used to determine the point in which the iron oxide removal is complete. This is indicated by a reduction of the amount of water present after each dose until ultimately no further water is produced. The HCL must be added in an accurate and consistent quantity for each dose in order to establish the trend and determine the endpoint. A high flow rate, high delivery pressure, and relatively large quantity of HCL during each dose requires a specialized heating and flow control system. The dosing process may take up to several days using multiple containers of HCL to complete.

As illustrated in FIGS. 1 through 9, a system 100 for supplying and managing hydrogen chloride gas for use in acidizing metal surfaces requiring high flow rates and pressures is provided. The system may include a single source of HCL supply, or a dual supply of HCL manifolds which operates as a primary and secondary supply. As such, the dual supply system contains components of identical purpose and are designated left or right using the suffix "A" or "B" respectively. In a multi-train system, during operation, either side may be considered to be the primary or secondary. This document is generally written with respect to the A side functions. Where the dual functionality occurs, the ability to use the B side can be inferred. Where such A or B side devices exist, they are hereafter identified by the appropriate element number followed by "A(B)." The skilled artisan would also recognize that the system may be provided with more than two supplies, operating as described herein.

Figure 2A:
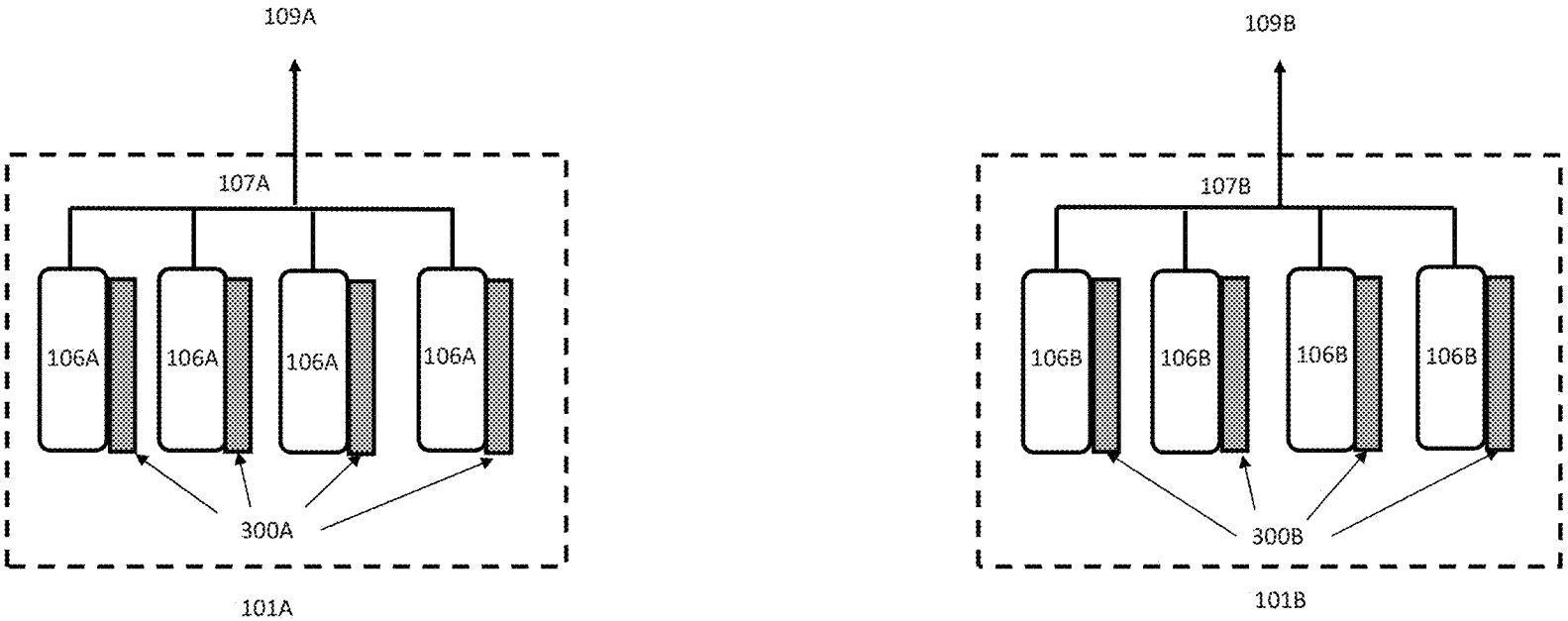
FIG. 2*a* is a schematic representation of the HCL source as a grouping of individual HCL cylinders, in accordance with one embodiment of the present invention.
Figure 2B:
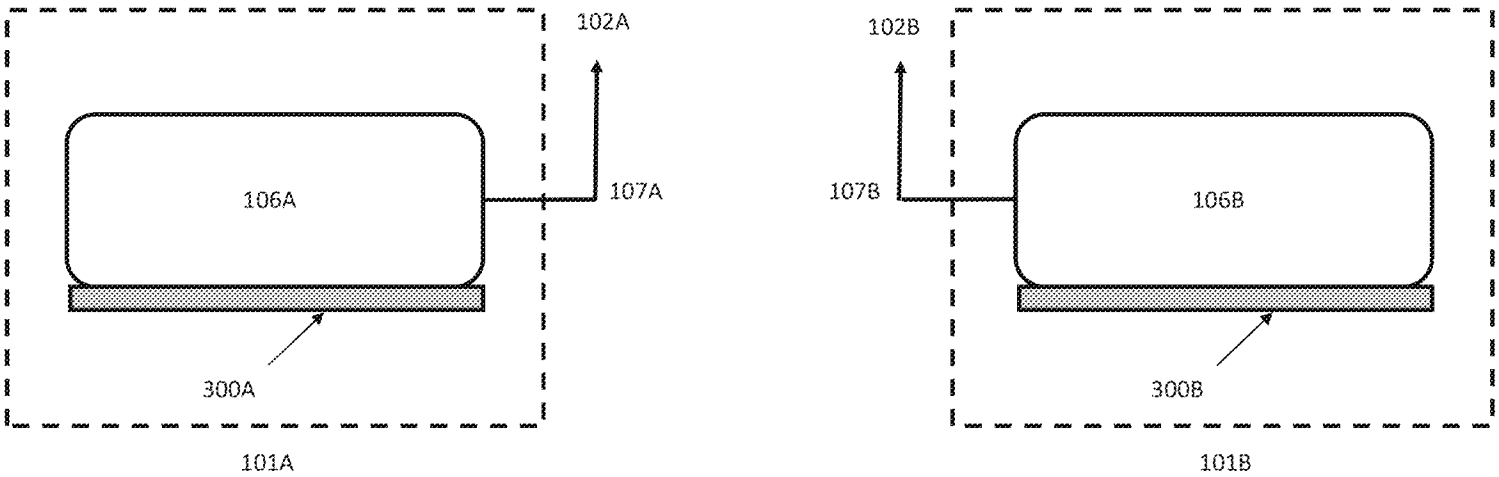
FIG. 2*b* is a schematic representation of the HCL source as single large HCL cylinders, in accordance with one embodiment of the present invention.
Figure 3:
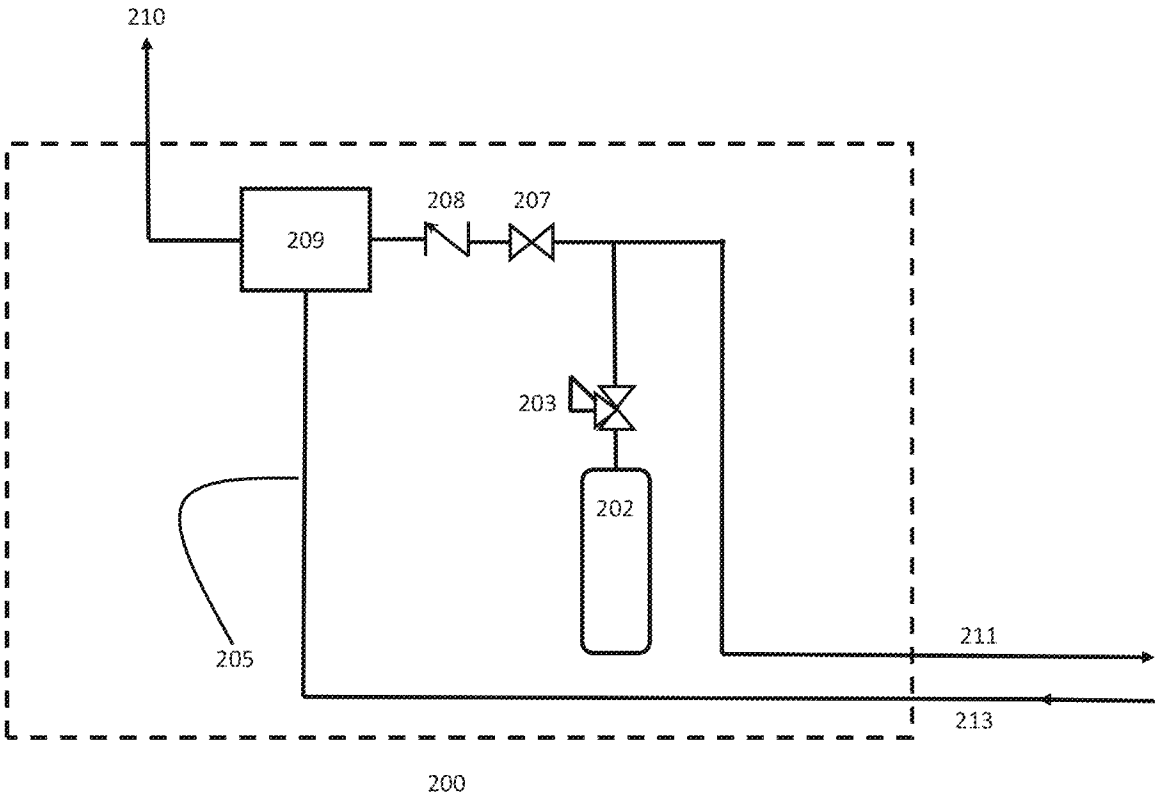
FIG. 3 is a schematic representation of the purge subsystem, in accordance with one embodiment of the present invention.

Independent sources of HCL gas 101A(B) may include one or more HCL cylinders or bulk container as shown in FIGS. 2*a* and 2*b*. FIG. 2*a* illustrates the grouping of up to four individual HCL cylinders 106A(B) connected together to a common manifold 107A(B). FIG. 2*b* illustrates the use of single large cylinders 106A(B).

The HCL manifolds, 109A(B), may include pressure sensor 501A(B) and/or mass flow and total flow measuring device 502. Pressure sensor 501A(B) may be connected to electronic monitoring and controls 400 by way of signal line 402. Mass flow and total flow measuring device 502 may be connected to electronic monitoring and controls 400 by way of signal line 401.

The system includes heating devices 300A(B) that apply heat to the HCL cylinders or bulk containers 101A(B). The HCL source temperature correlates to HCL source pressure.

The system may include pressure sensor 501A(B) which provides electronic communication of the supply pressure of each HCL source. As such, this electronic communication may be used for the control of the heating device as needed to maintain the respective HCL source system pressure. Heating device 300A(B) includes at least one temperature sensor 301A(B) for the purpose of monitoring and/or controlling the temperature of HCL source 101A(B).

Electronic controls 400 may include one or more devices, which may be either centralized or dispersed. Temperature, flow, weight, and/or pressure sensors provide electronic communication to the controls 400 for the purpose of managing and controlling the flow, pressure, and quantity of HCl to be dispensed. Additional inputs for external emergency shutdown 404, gas leak detector 405, or other device may be used for the purpose of automation and safety. Electronic controls 400 provides for processing the various inputs with a primary purpose of maintaining consistent batch additions of HCL for the purpose of iron oxide removal within a piping system.

The weight of one or more HCL cylinders, or bulk containers 101A(B) may be measured by HCL source weighing device 503A(B). This weight is used to track the amount of HCL removed from the cylinders during use of the system. HCL source weighing device 503A(B) may be connected to electronic monitoring and controls 400 by way of signal line 406.

Heating device 300A(B) contains an electric heating element and a minimum of one temperature sensor. The temperature sensors provide for a signal to the electronic controls 400 to regulate the HCL temperature and provide for a means to limit the maximum temperature of the HCL cylinder or container 101A(B).

HCL process supply gas valves 102A(B) and 103A(B) provide for isolation between the two independent sides. Two valves exist for the purpose of double-valve isolation as a safety feature. In closing these valves, the upstream manifold section is isolated from the shared HCL manifold 110 to allow for purging and cylinder replacement while allowing for the opposite side to continue to supply HCL for the dosing process.

Dosing valve, or automatic control valve, 104 is a single isolation valve designated for on/off control of the HCL dosing function. This valve may be manually operated or controlled by the electronic controls 400 via electrical or pneumatic signal 403. Control of valve 104 on/off is performed based on the total amount of HCL dosed as determined either flow measure device 502 or the weight reading scale 503A(B).

The flow rate of the HCL may be monitored using flow measuring device 502 and/or by monitoring the weight change from device 503A(B) over time. Control of the HCL flow rate is adjusted using the adjustable flow rate control valve 105.

Pressure measuring device 501A(B) may be used to monitor the supply pressure and provide an electronic signal to electronic controls 400 for the purpose of energizing electric heating devices 300A(B). The electronic heating device 300A(B) is necessary to restore energy to the HCL which has been removed by the latent heat of vaporization. Without heat, the reduced energy from use dramatically decreases temperature and thus pressure. The decrease in pressure is significant enough to prevent further flow of HCL.

Purge subsystem 200 includes inert purge gas source 202 and vacuum generating device 209. Purging of the HCL manifold and cylinder connections provides for removal of hazardous HCL from a selected segment of the manifold system to prevent a release of HCL when opening. Opening of the HCL system may be necessary for cylinder replacement, removal, and/or decommission.

A high-pressure inert gas cylinder 202, is provided as the purge gas source, and motive force of the vacuum generating device 209. Purge gas from purge gas source 202 passes through pressure reducing valve 203 to a working pressure. Inert purge gas is connected to system 100 through the purge gas line 211.

Purge subsystem 200 also includes vacuum line 213 connects system 100 to vacuum generating device 209 and then system discharge to a disposal system 210. When the vacuum generator motive valve 207 is open, sub-atmospheric pressure is created on the vacuum line to system 213. Backflow prevention valve 208 is located between vacuum generator motive gas valve 207 and vacuum generator 209. Through the manipulation of valves as described in detail below, this low-pressure region provides a discharge path for the removal of fluids from the system 100.

Electronic controls 400 may be a distributed control system (DCS), programmable logic controllers (PLC), or any system known in the art. Electronic controls 400 includes at least control of the temperature of the HCL supply containers 101A(B). Electronic controls 400 may provide additional control of feed valve 104 based on user programmable parameters of the amount of HCL desired as measured by HCL container weight measurement device 503A(B) and/or inline flow measurement device 502.

One or more electronic control systems 400 may be configured and programmed to receive operational data from one or more of volumetric flow sensor 502, weight measuring devices 503A(B), temperature sensors 507A(13), and pressure sensors 501A(B) and initiate or cease hydrogen chloride gas flow based on the operational data. The operational data and an electronic control system 400 action based thereon may comprise one or more of the following.

1) The operational data is a total gas flow measured by volumetric flow sensor 502 and electronic control system 400 ceases an ongoing delivery of hydrogen chloride.

2) The operational data is a total change in weight measured by weight measuring devices 503A(B) and electronic control system 400 ceases an ongoing delivery of hydrogen chloride.

The system 100 may include:

1) One or more of pressure sensors 501A(B) and activate, deactivate, or adjust a temperature set point for heating device 300A(B) based on a predetermined operating pressure for source of hydrogen chloride gas 101A(B).

2) One or more of temperature sensors 507A(B) and activate, deactivate, or adjust a temperature set point for heating device 300A(B) based on a predetermined operating temperature for source of hydrogen chloride gas 101A(B).

3) A gas leak detection device 404 which energizes visual and audible alarm notification device 405 upon sensing ambient air HCL concentrations above a predetermined concentration.

4) A flow measurement device 502 which energizes visual and audible alarm notification device 405 based on predetermined low or high flow rate during the dosing process.

Figure 4:
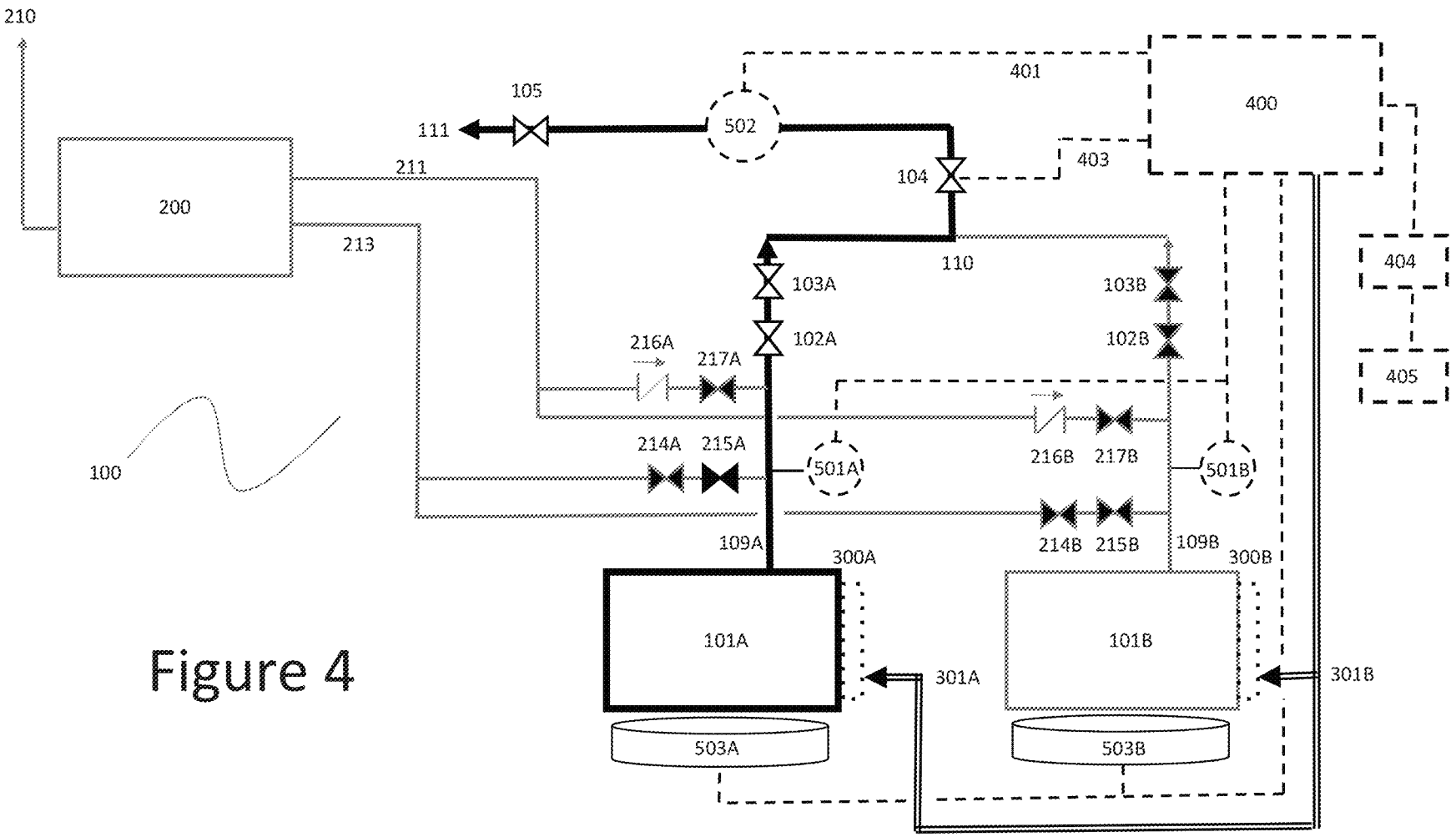
FIG. 4 is a schematic representation of the overall system, indicating the first operating mode, in accordance with one embodiment of the present invention.

Turning now to FIG. 4, a first operating mode is illustrated. This is essentially the basic operating mode for the system. In a multi-train system, the flow gas source 101A (left-side) is active, and the second gas source 1018 (right-side) is inactive. The skilled artisan would recognize that the flow gas source 101B (right-side) may be active, and the second gas source 101A (left-side) may be inactive. In this operating mode, if no other activity is taking place, such as evacuating or purging of the idle side HCL source, all the system valves are closed (as indicated in solid black) except for first HCL manifold isolation valve 102A, second HCL manifold isolation valve 103A, dosing valve 104, and adjustable flow rate control valve 105, In a single train system, this side is active. As is indicated with the heavy black line, the pressurized HCL leaves HCL gas first source 101A, passes through first HCL manifold isolation valve 102A and second HCL manifold isolation valve 103A, then passes through dosing valve 104, then passes through adjustable flow rate control valve 105. As described above, should certain operational data on the process or flow conditions present in this circuit may cause one or more of these valves to be modified.

Figure 5:
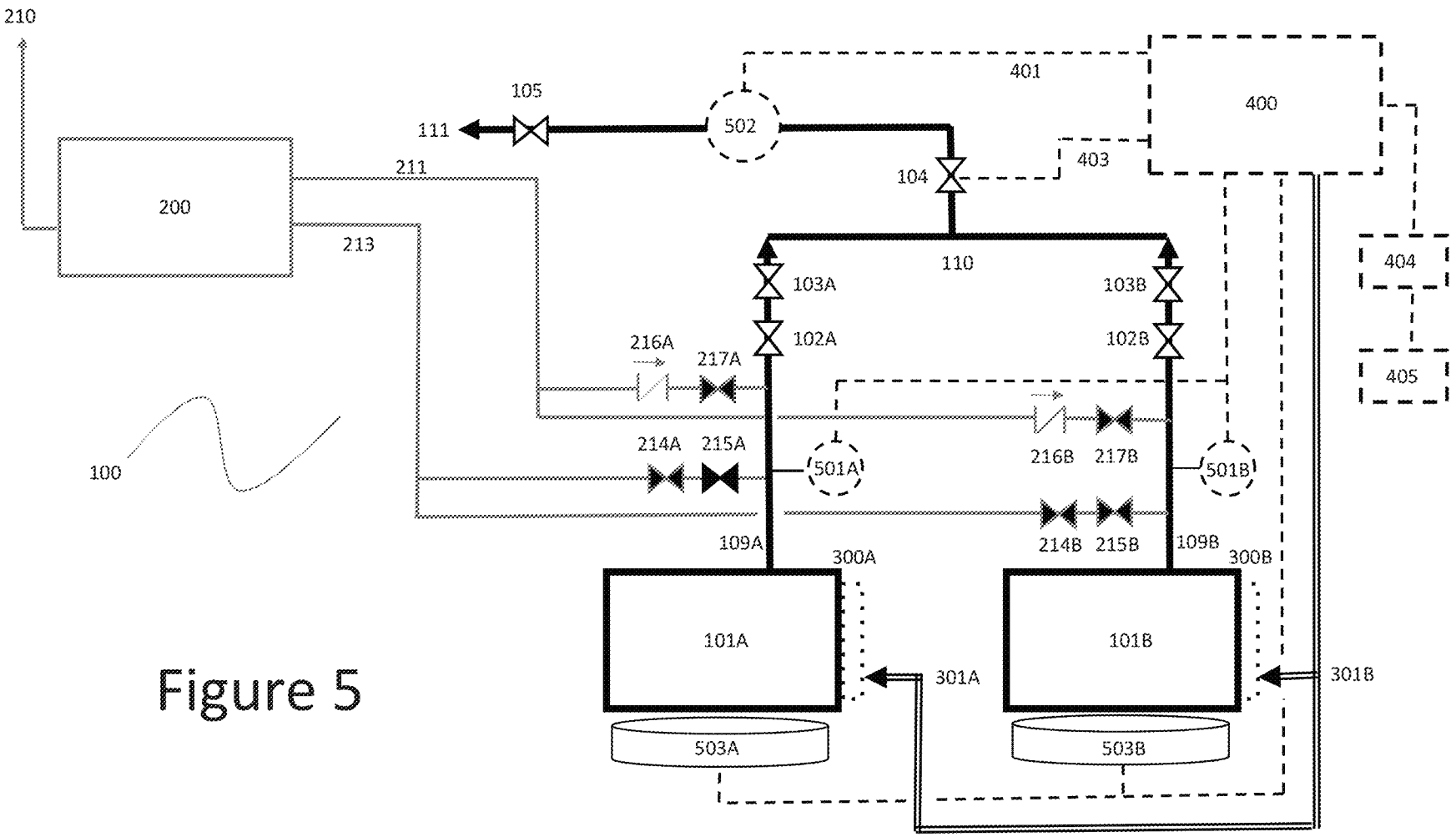
FIG. 5 is a schematic representation of the overall system, indicating the second operating mode, in accordance with one embodiment of the present invention.

FIG. 5 indicates a second operating mode. In a multi-train system, this is a parallel operating mode in which the second gas source 101B (right-side) is active in addition to gas source 101A (left-side). In this operating mode, the supply of HCL is provided by both sources 101A and 101B for maximum HCL flow and product consumption by supplying both left and right HCL supply sources through the common manifold 110, dosing valve 104, and then through adjustable flow rate control valve 105. In this operating mode, the system is limited to gas supply only and does not allow for other activities, such as evacuating or purging either HCL source.

Figure 6:
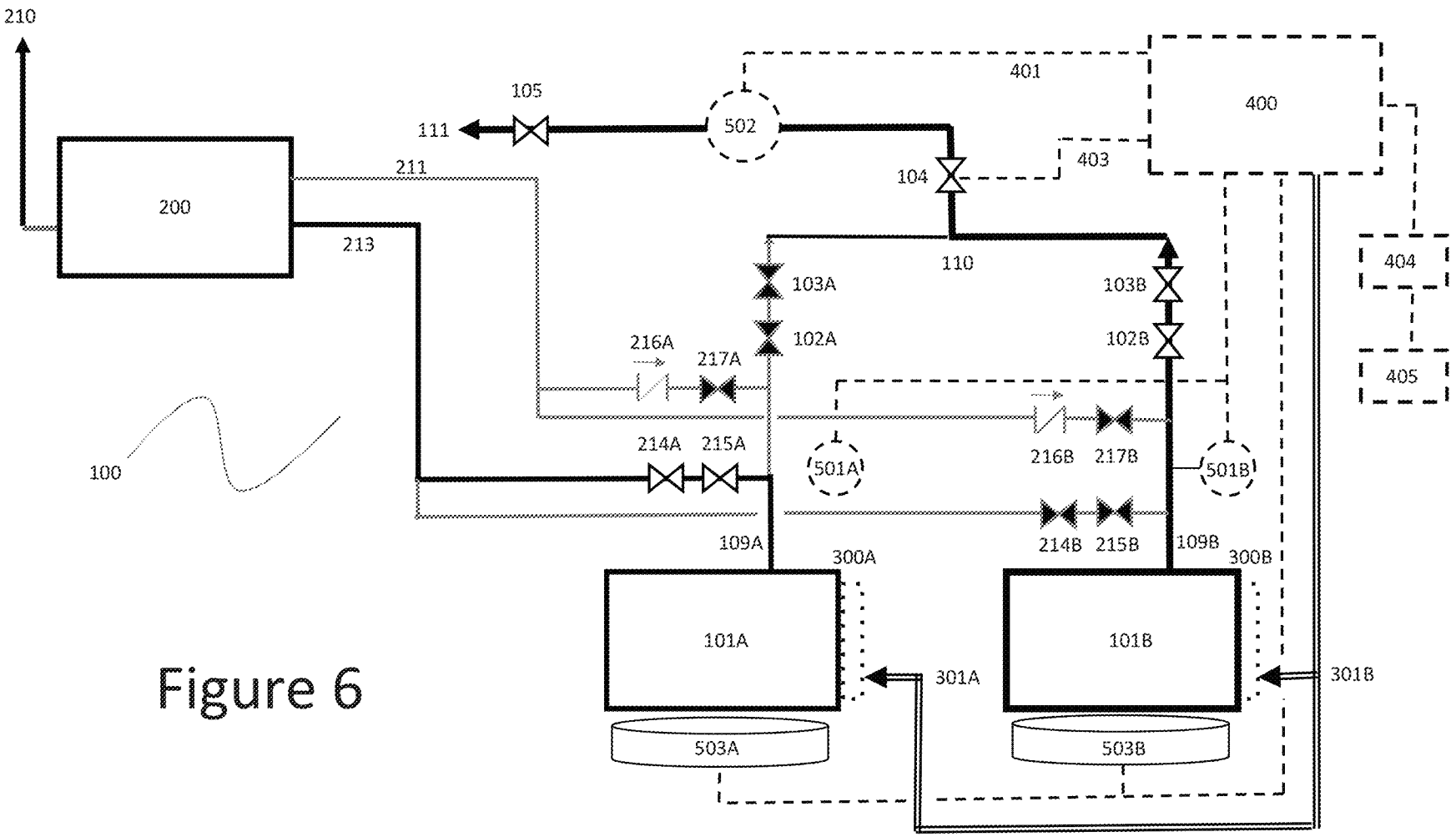
FIG. 6 is a schematic representation of the overall system, indicating the third operating mode, in accordance with one embodiment of the present invention.
Figure 8:
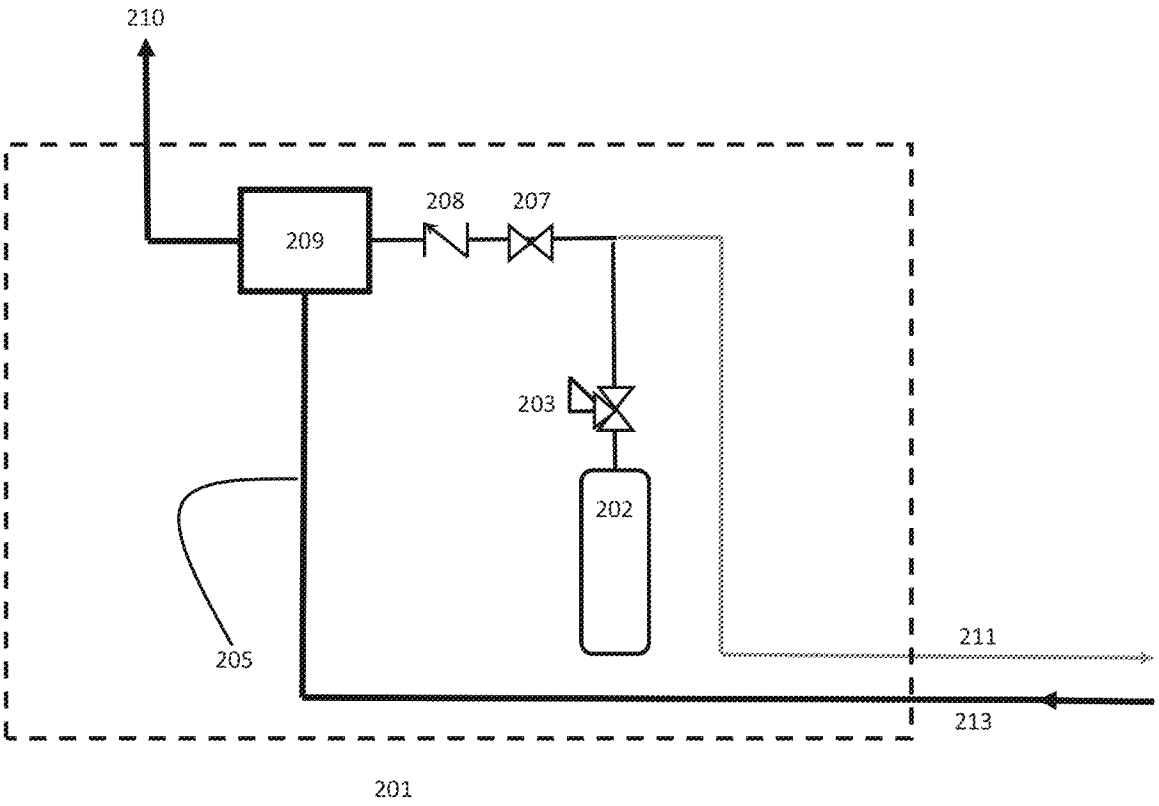
FIG. 8 is a schematic representation of the purge subsystem, indicating the evacuation mode, in accordance with one embodiment of the present invention.

Turning now to FIG. 6, the third operating mode is illustrated. In this embodiment, FIG. 6 provides for the flow path of the evacuation of HCL gas from the left-side supply manifold 109A. In a single train system, this single train is evacuating the HCL gas as described. FIG. 6 also represents the basic supply mode of HCL for dosing using the right-side source 101B. In a multi-train system, the skilled artisan would recognize that the evacuation of HCL gas may be from the right-side supply manifold 109B with or without the left-side in basic supply mode. In accordance with the third operating mode, the purge system 200 flow path is represented by heavy black lines in FIG. 8, The design of the system allows either side (left or right) to be active while the opposite side is charged and flowing HCL (Mode 1 flow path in use). In FIG. 6, for the vacuum/purge circuit, any gas within the system such as HCL or purge gas, is removed by the opening of the first 214A(B), and second 215A(B) line evacuation valves. FIG. 8 illustrates the concurrent flow path for evacuation using the vacuum generator of the purge subsystem 200 with the vacuum generator motive gas valve 207 open.

Figure 7:
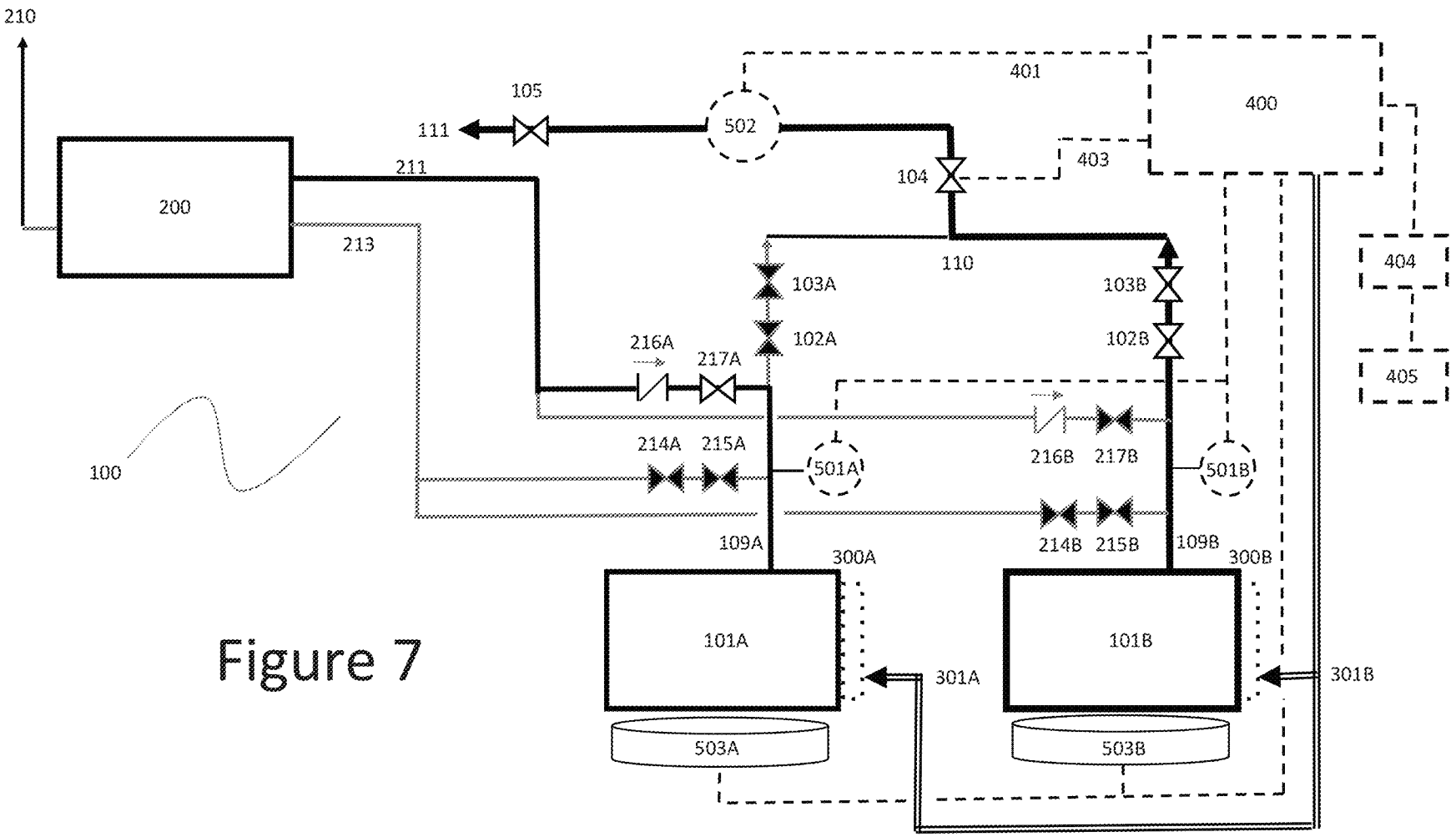
FIG. 7 is a schematic representation of the overall system, indicating the fourth operating mode, in accordance with one embodiment of the present invention.
Figure 9:
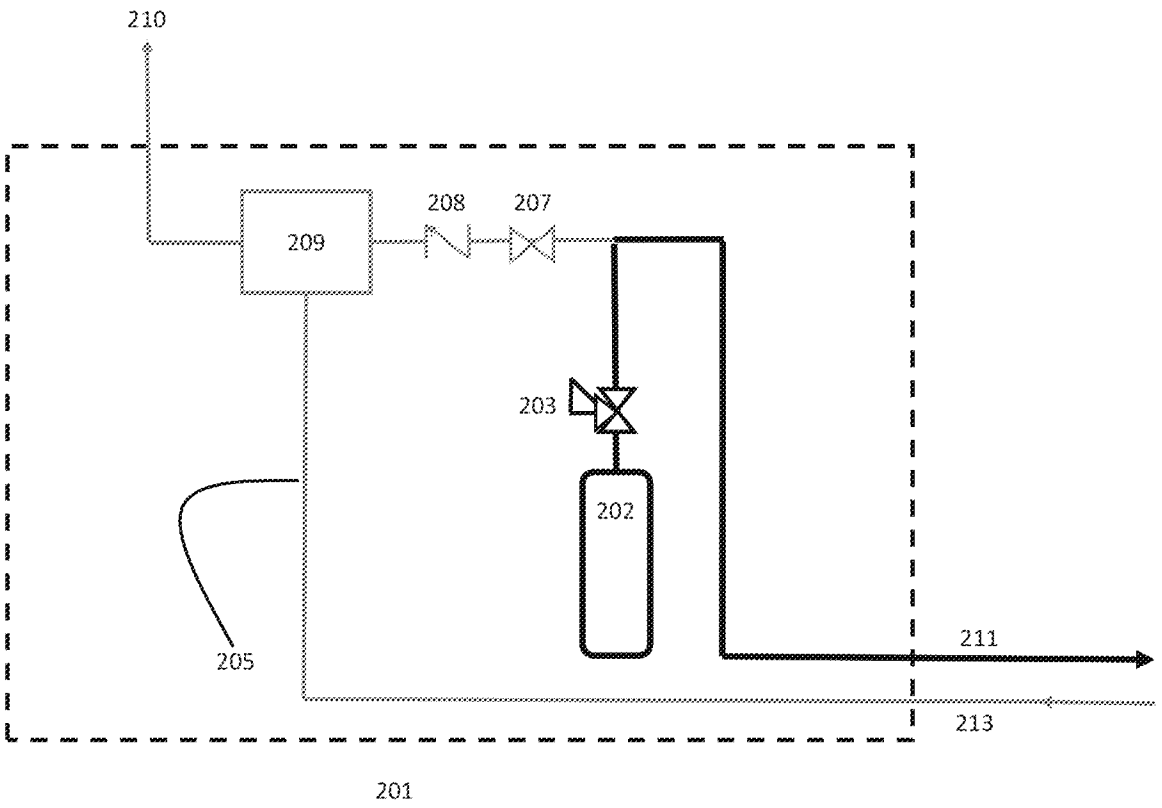
FIG. 9 is a schematic representation of the purge subsystem, indicating the purge mode, in accordance with one embodiment of the present invention.

Turning now to FIG. 7, the fourth operating mode is illustrated. In this embodiment, FIG. 7 provides for the flow path of providing inert purge gas to the left-side supply manifold 109A, FIG. 7 also represents the basic supply mode of HCL for dosing using the right-side source 101B. In a single train system, this single train is purging with inert gas as described, FIG. 7 provides for the flow path of providing inert purge gas to the right-side supply manifold 109B. In accordance with the fourth operating mode, the purge system 200 flow path is represented by heavy black lines in FIG. 9. The design of the system provides for Mode 4 to be active on either side (left or right) while the opposite side is charged and flowing HCL (Mode 1 flow path in use). In FIG. 7, Mode 4, for the vacuum/purge circuit, the purge gas inlet valve 217A(B) is open to provide inert gas from the purge gas supply line 211 into the HCL supply manifold 109A(B). Prevention of backflow of HCL is provided by one-way valve 216A(B). FIG. 9 illustrates the concurrent flow path for the supply of purge gas from purge subsystem 200.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of dosing a system with HCL, comprising at least two parallel trains, the method comprising:

utilizing a first operating mode, wherein at least one primary train is actively providing HCL to an end user, and at least one secondary train is either inactive or also providing HCL to the end user, utilizing a second operating mode, wherein the at least one primary train is evacuating the contents of the train to a disposal system, and the at least one secondary train is providing HCL to the end user, utilizing a third operating mode, wherein the at least one primary train is purging the train, and the at least one secondary train is providing HCL to the end user, wherein the first operating mode, the second operating mode, and the third operating mode are controlled by an electronic monitoring and control system.

2. The method of claim 1, wherein the electronic monitoring and control system comprises a distributed control system or a programmable logic controller.

3. The method of claim 1, wherein during the first operating mode the at least one secondary train is inactive.

4. The method of claim 1, wherein during the first operating mode the at least one secondary train is omitted.

5. The method of claim 1, further comprising an active circuit, the active circuit comprising:

at least one first isolation block valve fluidically connected to at least one HCL cylinder or bulk container by way of a common manifold assembly, at least one second isolation block valve fluidically connected to the at least one first isolation block valve and an automatically controlled, dosing valve, a flow rate and total flow measuring device fluidically connected to the automatically controlled, dosing valve and an adjustable flow rate control valve, and a gas outlet to the system to be acidified fluidically connected to the adjustable flow control valve.

6. The method of claim 5, further comprising one or more heating devices configured to apply heat to the at least one HCL cylinder or bulk container, and one or more temperature sensor, wherein the one or more temperature sensor provides input to the electronic monitoring and control system, wherein the maximum temperature of the supply cylinder cannot exceed the maximum temperature limit provided by the manufacturer.

7. The method of claim 5, further comprising one or more HCL source weighing device configured to measure the weight of the at least one HCL cylinder or bulk container, wherein the one or more HCL source weighing device provides input to the electronic monitoring and control system.

8. The method of claim 1, further comprising an evacuation circuit, the evacuation circuit comprising:

a first vacuum line evacuation valve fluidically connected to at least one HCL cylinder or bulk container, a second vacuum line evacuation valve fluidically connected to the first vacuum line evacuation valve and a vacuum generating device, the vacuum generating device, a vacuum line fluidically connecting the vacuum generating device to the primary train, and a system discharge line fluidically connecting the vacuum generating device to the disposal system.

9. The method of claim 8, wherein utilizing the second operating mode comprises:

opening the first vacuum line evacuation valve and second vacuum line evacuation valve, activating the vacuum generating device, and discharging the evacuated fluids into the disposal system.

10. The method of claim 1, further comprising a purging circuit, the purging circuit comprising:

an inert gas source, a purge gas pressure regulator valve fluidically connecting the inert gas source to a purging gas line, the purging gas line fluidically connecting the purge gas pressure regulator valve to a backflow prevention valve, the backflow prevention valve fluidically connected to the purging gas line and a purge gas inlet valve, the purge gas inlet valve, fluidically connected to the backflow prevention valve and to at least one HCL cylinder or bulk container.

11. The method of claim 10, wherein utilizing the third operating mode comprises:

opening the purge gas pressure regulator valve and the purge gas inlet valve, discharging the purge gas into the primary train.

* * * * *